US008038514B2

(12) United States Patent
Hidai et al.

(10) Patent No.: US 8,038,514 B2
(45) Date of Patent: Oct. 18, 2011

(54) MILLING TOOL

(75) Inventors: Yasuhiro Hidai, Kurume (JP); Naoki Toge, Kurume (JP); Shizuka Ishii, Kurume (JP)

(73) Assignees: Noritake Super Abrasive Co., Ltd., Kurume-shi (JP); Noritake Co., Limited, Nagoya-shi (JP)

( * ) Notice: Subject to any disclaimer, the term of this patent is extended or adjusted under 35 U.S.C. 154(b) by 400 days.

(21) Appl. No.: 12/385,910

(22) Filed: Apr. 23, 2009

(65) Prior Publication Data

US 2009/0274524 A1 Nov. 5, 2009

(30) Foreign Application Priority Data

Apr. 30, 2008 (JP) ..... 2008-119017

(51) Int. Cl.
*B24B 7/00* (2006.01)

(52) U.S. Cl. ..... 451/548; 451/457

(58) Field of Classification Search ..... 451/546–549, 451/158, 540, 541, 550
See application file for complete search history.

(56) References Cited

U.S. PATENT DOCUMENTS

| | | | | |
|---|---|---|---|---|
| 5,406,929 | A | 4/1995 | Udert et al. | |
| 6,926,598 | B2 * | 8/2005 | Toge et al. | 451/540 |
| 7,540,802 | B2 * | 6/2009 | Nonoshita et al. | 451/443 |
| 2004/0198206 | A1 * | 10/2004 | Toge et al. | 451/547 |

FOREIGN PATENT DOCUMENTS

| | | | |
|---|---|---|---|
| EP | 1462217 | A1 * | 9/2004 |
| JP | 06-210571 | A | 8/1994 |
| JP | 10-193269 | A | 7/1998 |
| JP | 10-193326 | A | 7/1998 |
| JP | 2002-263937 | | 9/2002 |
| JP | 2002-331459 | A | 11/2002 |
| JP | 2005-279851 | | 10/2005 |
| JP | 2007-152516 | | 6/2007 |

* cited by examiner

*Primary Examiner* — Dung Van Nguyen
(74) *Attorney, Agent, or Firm* — Fitch, Even, Tabin & Flannery

(57) ABSTRACT

A milling tool includes a cylindrical base and a plurality of abrasive grain clusters. The cylindrical base is centrally formed with a through-hole, and has an annular surface extending around the through-hole, a peripheral surface extending perpendicularly to the annular surface, and an inclined or rounded surface connecting the annular and peripheral surfaces. The annular surface is formed with a circular recess groove coaxially with the through-hole for separating the annular surface into first and second planar areas that respectively are closer to and farther from the peripheral surface. The second planar area is higher than the first planar area. Abrasive grains are brazed on the annular surface. The abrasive grain clusters are brazed on the inclined surface at predetermined intervals, each cluster including a predetermined number of abrasive grains having substantially the same diameter, each cluster being positioned substantially on a circumference almost equidistant from one another.

4 Claims, 6 Drawing Sheets

MILLING TOOL

This application is based upon and claims the benefit of priority from Japanese Patent Application No. 2008-119017 filed on Apr. 30, 2008, the entire disclosure of which, including specification, claims, drawings and summary, is incorporated herein by reference in its entirety.

BACKGROUND OF THE INVENTION

1. Field of the Invention

The invention relates to a milling tool which is capable of simultaneously accomplishing rough milling and finish milling when a complex material comprised of a harder material and a softer material is milled.

2. Description of the Related Art

As a milling tool for milling a surface of cast alloy or ceramics, conventionally a tool was used that included an abrasive grain layer comprised of hard abrasive grains such as diamond. In such a surface milling process a, a high milling efficiency is required with a preferable finished surface roughness presenting a small number of scratches.

On the other hand, for instance, when a complex material comprised of iron and aluminum (hereinafter, referred to simply as "iron-aluminum complex material") to be used for automobile parts such as an engine and a gear is milled, it is sometimes necessary to carry out both rough milling and finish milling to accomplish the desired dimensions of a final product. Japanese Patent Application Publications Nos. 2002-263937 and 2007-152516 have suggested a milling tool that is capable of carrying out both rough milling and finish milling by use of a single tool.

The milling tool suggested in Japanese Patent Application Publication No. 2002-263937 includes a cup-shaped base. Diamond abrasive grains are brazed on an end surface and a peripheral surface of the base to define a milling tool. A recess groove is formed at the end surface along a boundary between an outer area and an inner area. The recess groove prevents big chips generated when the outer area is roughly milled, from entering the inner area acting as a finish-milling tool, to thereby enhance a finish accuracy with which finish milling is carried out on a workpiece. Furthermore, the suggested milling tool can accomplish both rough milling and finish milling at a time.

A planar surface of the inner area is designed higher than a planar surface of the outer area, ensuring that abrasive grains arranged in the inner area can sufficiently bite a surface of the workpiece after the surface has been milled by means of the outer area. As a result, it is possible to efficiently mill the workpiece.

The milling tool suggested in Japanese Patent Application Publication No. 2007-152516 is comprised of a grinding stone including a cup-shaped base. Diamond abrasive grains are brazed onto an end surface of the base to define an abrasive layer. A recess groove is formed at the end surface along a boundary between an outer area disposed closer to the end surface and an inner area disposed more distant from the end surface. The inner area has a planar surface higher than a planar surface of the outer area. The outer area has an inclined or rounded surface at an outer edge thereof. In a portion of the inner area close to the recess groove, an inclined surface is formed downwardly inclining towards the recess groove. The portion of the inner area and a portion of the outer area close to the recess groove are almost equal in height to each other.

Particularly high loads act on abrasive grains fixed in the inner area. The milling tool having the above-mentioned structure can disperse the loads to thereby allow the abrasive grains to wear uniformly, ensuring enhancement in both accuracy with which the milling tool mills a workpiece, and the lifespan of the milling tool.

When a workpiece composed of a material having a low hardness is milled by means of a milling tool including abrasive grains fixedly brazed to a base, the abrasive grains are often blocked by the chips chips generated during milling.

In order to prevent abrasive grains from being blocked by the chips, Japanese Patent Application Publication No. 2005-279851 has suggested a rotary disc cutter including a plurality of abrasive-grain clusters spaced away from one another by a predetermined distance, each of the abrasive-grain clusters being comprised of a centrally disposed single abrasive grain, and a plurality of abrasive grains disposed on a concentric circle around the central abrasive grain.

The above-mentioned iron-aluminum complex material is accompanied with a problem that since the material has different hardness, chips generated when a harder material (that is, iron) was milled flaw a softer material (that is, aluminum), resulting in reducing an accuracy with which a workpiece is milled.

The suggested milling tool is accompanied further by a problem in that free abrasive grain(s) having fell off a base during milling a workpiece flaws both a harder material (that is, iron) and a softer material (that is, aluminum).

In the milling tool suggested in Japanese Patent Application Publication No. 2002-263937, abrasive grains disposed in the inner area can bite a workpiece well by designing a planar surface of the inner area to be higher than a planar surface of the outer area. However, since high loads act on abrasive grains disposed in the inner area in the vicinity of the recess groove, the abrasive grains are worn out irregularly, resulting in reducing both accuracy with which a workpiece is milled and a lifespan of the grinding stone.

Furthermore, abrasive grains are disposed one by one with a predetermined space between adjacent ones in the suggested milling tool. Hence, a high pressure acts on each of the abrasive grains while a workpiece is being milled, some abrasive grains are likely to fall out of the milling tool.

In addition, since abrasive grains deeply bite a workpiece, inevitably big chips are generated, causing chips resulted from a harder material to flaw a portion of the workpiece composed of a softer material.

In accordance with the milling tool suggested in Japanese Patent Application Publication No. 2007-152516, since loads are dispersed to abrasive grains disposed in the inner area of an end surface, it would be possible to allow for the uniform wear of the abrasive grains. However, since abrasive grains are disposed one by one at an edge of the end surface, the problem that abrasive grains disposed at an edge on which a highest load acts are likely to fall is not yet solved.

In the rotary disc cutter suggested in Japanese Patent Application Publication No. 2005-279851, the abrasive-grain clusters are disposed on a side surface of the rotary disc cutter. Each of the abrasive-grain clusters is comprised of a single abrasive grain, and a plurality of abrasive grains on a concentric circle around the single abrasive grain. In the rotary disc cutter, loads acting on one of the abrasive grains defining an abrasive-grain cluster while a workpiece is being milled are dispersed to the adjacent abrasive grains. Accordingly, since a force acting on each of the abrasive grains is smaller than a force acting on a singly disposed abrasive grain, the abrasive grains in the rotary disc cutter are not likely to fall off the milling center.

The inventors of the present invention tested milling workpieces composed of an iron-aluminum complex material through the use of a milling tool including the same abrasive-grain clusters suggested in Japanese Patent Application Publication No. 2005-279851, resulting in failure in obtaining an adequate milling accuracy. In particular, it was found that a centrally disposed abrasive grain in an abrasive-grain cluster has fell at an outermost area of the milling tool.

It is considered that this is because a load acting on an outermost area of the milling tool while a workpiece is being milled is much greater than a load acting on an edge of the rotary disc cutter suggested in Japanese Patent Application Publication No. 2005-279851 while a workpiece is being milled, and hence, a centrally disposed abrasive grain, that is, an abrasive grain brazed to a base with lowest bonding force among abrasive grains defining an abrasive-grain cluster falls.

SUMMARY OF THE INVENTION

In view of the above-mentioned problems in the related art, it is an exemplary object of the present invention to provide a milling tool which is capable of making smaller chips resulted from a harder material portion of a workpiece while the workpiece composed of a complex material comprising a harder material and a softer material, such as an iron-aluminum complex material, is being milled, and preventing abrasive grains from falling off a base.

The inventors tested and studied milling tools to thereby discover that it was possible to make smaller chips and prevent abrasive grains from falling, by designing an abrasive-grain cluster to have an improved arrangement of abrasive grains.

In an exemplary aspect of the present invention, there is provided a milling tool including a cylindrical base, a plurality of abrasive grains and abrasive-grain clusters, the cylindrical base being centrally formed with a through-hole, and having an annular surface extending around the through-hole, a peripheral surface extending perpendicularly to the annular surface, and an inclined or rounded surface connecting the annular surface and the peripheral surface to each other, the annular surface being formed with a circular recess groove coaxially with the through-hole for separating the annular surface into a first planar area closer to the peripheral surface and a second planar area remoter from the peripheral surface, the second planar area being higher than the first planar area, the abrasive grains being brazed on the annular surface, the abrasive-grain clusters being brazed on the inclined or rounded surface at a predetermined space from adjacent ones, each of the abrasive-grain clusters being comprised of a predetermined number of abrasive grains having an almost same diameter, and being positioned substantially on a common circumference at an almost equal space from adjacent ones.

Herein, the phrase "an almost same diameter" indicates that diameters of all abrasive grains are within ±10% of an average diameter of the abrasive grains.

The phrase "positioned substantially on a common circle at an almost constant space from adjacent ones" indicates that abrasive grains are arranged on a circumference of a circle, and centers of the abrasive grains are almost equally spaced from centers of the adjacent abrasive grains, in which case, an abrasive grain is not positioned in the circle, in particular, at a center of the circle.

In the milling tool in accordance with the present invention, the abrasive-grain clusters comprised of a plurality of abrasive grains positioned almost on a circumference are arranged at a predetermined space from one another at an outermost area of the base on which a highest load acts, ensuring a load acting on each of the abrasive grains defining each of the abrasive-grain clusters while a workpiece is being milled is dispersed.

Thus, since each of the abrasive grains bites to a smaller degree, a size of generated chips is made smaller, and chips are smoothly removed without staying in the abrasive-grain clusters because the abrasive grains defining each of the abrasive-grain clusters are arranged on a circumference.

Furthermore, since each of the abrasive-grain clusters disposed at an outermost area of the base does not include an abrasive grain within a circle along which abrasive grains are positioned, each of the abrasive grains is firmly adhered to the base by means of brazing filler material existing within and outside the circle.

It is possible to disperse a load to act on each of the abrasive grain by designing the abrasive-grain clusters as mentioned above, and to firmly adhere abrasive grains defining each of the abrasive-grain clusters to the base by means of brazing filler material, ensuring that abrasive grains positioned at an outermost area of the base on which a highest load acts are prevented from falling off. Accordingly, it is possible to avoid the generation of free abrasive grains, which flaw a workpiece.

It is preferable that the predetermined number of abrasive grains is in the range of 3 to 8 both inclusive, and it is more preferable that the predetermined number of abrasive grains is in the range of 5 to 8 both inclusive. If the predetermined number is two (2), a load acting on abrasive grains is not adequately reduced, resulting in that abrasive grains are likely to fall off the base. If the predetermined number is more than eight (8), the effect of reducing the load on each of the abrasive grains by forming the abrasive-grain clusters is no longer improved, and each of the abrasive-grain clusters unavoidably becomes big in size with the result of unpreferable increase in a resistance with which a workpiece is milled.

It is preferable that the abrasive grains disposed adjacent to each other in each of the abrasive-grain clusters make contact with the adjacent ones.

A particularly high load acts on abrasive grains disposed at a front in a direction in which the milling tool rotates. By arranging the abrasive grains disposed adjacent to each other to make contact with each other, a load acting on an abrasive grain is transferred to adjacent abrasive grains, and hence, loads acting on the abrasive grains are uniformized, ensuring that abrasive grains are not likely to fall off the base.

Furthermore, it is possible to reduce a volume of brazing filler material to be consumed in the arrangement in which abrasive grains disposed adjacent to each other to make contact with each other, relative to a volume of brazing filler material to be consumed in the arrangement in which abrasive grains do not make contact with adjacent ones.

When abrasive grains are positioned not to make contact with adjacent ones, the brazing filler material is used not only at areas at which the abrasive grains make contact with the base, but also at areas around the above-mentioned areas. Thus, a volume of the brazing filler material adhered around the abrasive grains is relatively great within a total volume of the brazing filler material to be consumed.

In contrast, by arranging each of the abrasive grains to make contact with adjacent ones, it is possible to reduce a volume of brazing filler material to be used around each of the abrasive-grain clusters, relative to a total volume of brazing filler material to be consumed.

Preferably, the space between the abrasive grains disposed adjacent to each other in each of the abrasive-grain clusters is equal to or smaller than 1.2X, more preferably, 1.0X wherein X indicates a diameter of the abrasive grains.

Herein, "the space between the abrasive grains disposed adjacent to each other" indicates a space between outer surfaces of abrasive grains disposed adjacent to each other. Specifically, "the space between the abrasive grains disposed adjacent to each other" is equal to a difference between the space between centers of abrasive grains disposed adjacent to each other and a diameter of an abrasive grain.

When abrasive grains are arranged with a space therebetween, in comparison with the above-mentioned arrangement in which abrasive grains disposed adjacent to each other make contact with each other, abrasive grains are adhered to the base with an increased force caused by brazing filler material because the brazing filler material exists in the space formed between abrasive grains disposed adjacent to each other.

The reason why the space between the abrasive grains disposed adjacent to each other in each of the abrasive-grain clusters is equal to or smaller than 1.2X, more preferably, 1.0X is that if abrasive grains were arranged to be disposed adjacent to each other, brazing filler material raised up to an upper portion of an abrasive grain by capillary force, and the advantage of enhancement in an adhesive force by which an abrasive grain is adhered to the base by brazing filler material was experimentally found, if the space between the abrasive grains disposed adjacent to each other was equal to or smaller than 1.2X.

Preferably, the predetermined space between the abrasive-grain clusters is in the range of 1X to 10X both inclusive wherein X indicates a diameter of the abrasive grains.

Herein, "the predetermined space between the abrasive-grain clusters" indicates a minimum distance between a first abrasive grain included in a first abrasive-grain cluster and a second abrasive grain included in a second abrasive-grain cluster disposed adjacent to the first abrasive-grain cluster, the first abrasive grain being disposed closest to the second abrasive grain among abrasive grains defining the first abrasive-grain cluster.

Since the size of chips generated while a workpiece being milled is dependent on a diameter of abrasive grains defining an abrasive-grain cluster, if a space between abrasive-grain clusters disposed adjacent to each other were smaller than 1X, it would be quite difficult to smoothly remove the chips, which attach to a base in a molten condition Furthermore, if another abrasive-grain cluster is disposed in the vicinity of a certain abrasive-grain cluster, a load generated while a workpiece is being milled acts on the abrasive-grain clusters, and hence, each of the abrasive-grain clusters receives the decreased load. If a space between abrasive-grain clusters disposed adjacent to each other were greater than 10X, it would be almost impossible to obtain the advantage of reduction in a load acting on each of the abrasive-grain clusters.

The exemplary advantages obtained by the above-mentioned invention are described hereinbelow.

The milling tool in accordance with the present invention is capable of making smaller chips while the workpiece composed of a complex material comprising a harder material and a softer material, such as an iron-aluminum complex material, is being milled.

As a result, this milling tool is capable of preventing abrasive grains from falling off a base, and preventing a workpiece from being flawed by chips and/or free abrasive grains.

The above and other objects and advantageous features of the present invention will be made apparent from the following description made with reference to the accompanying drawings, in which like reference characters designate the same or similar parts throughout the drawings.

DESCRIPTION OF THE EXEMPLARY EMBODIMENTS

Exemplary embodiments in accordance with the present invention will be explained hereinbelow with reference to drawings.

Figure 1:
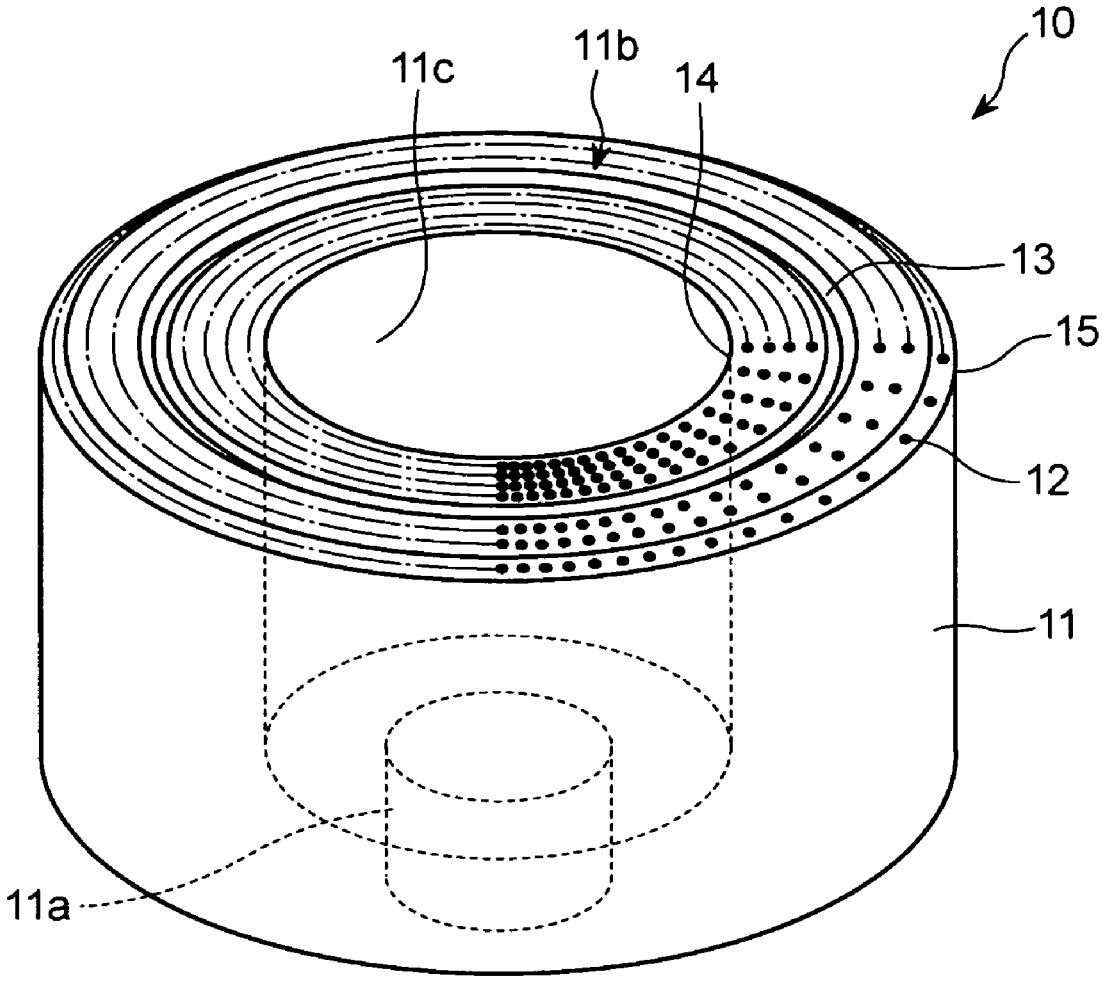
FIG. 1 is a perspective view of a milling tool in accordance with an exemplary embodiment of the present invention.
Figure 2A:
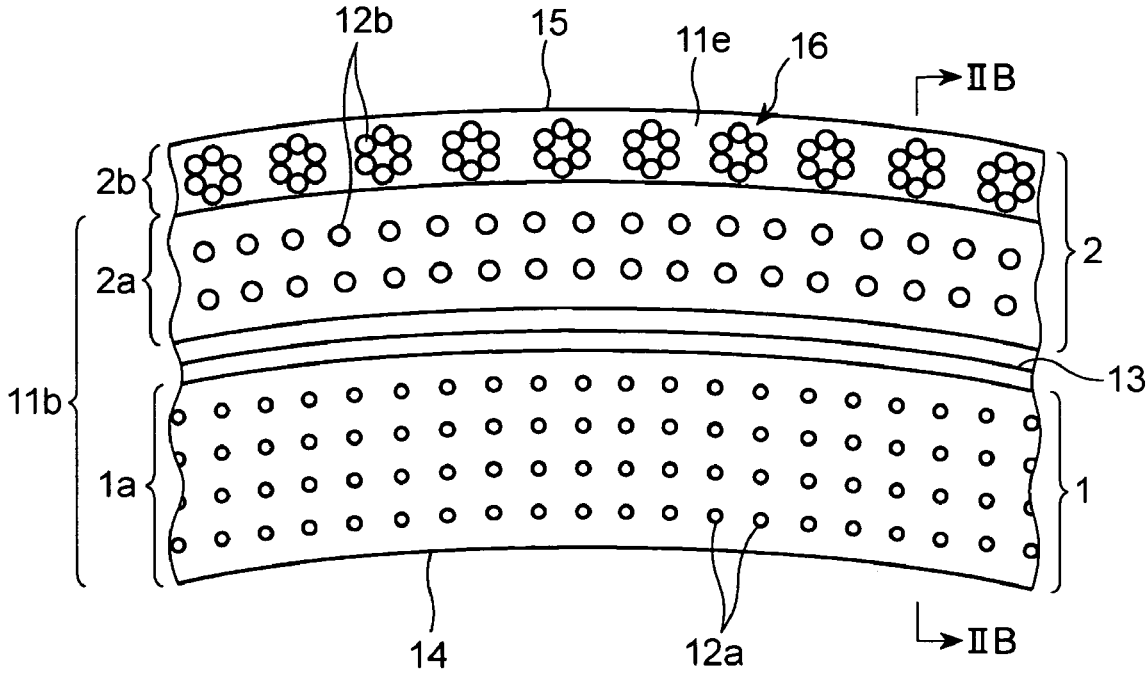
FIG. 2A is an enlarged plan view of a portion of the milling tool in accordance with an exemplary embodiment of the present invention.
Figure 2B:
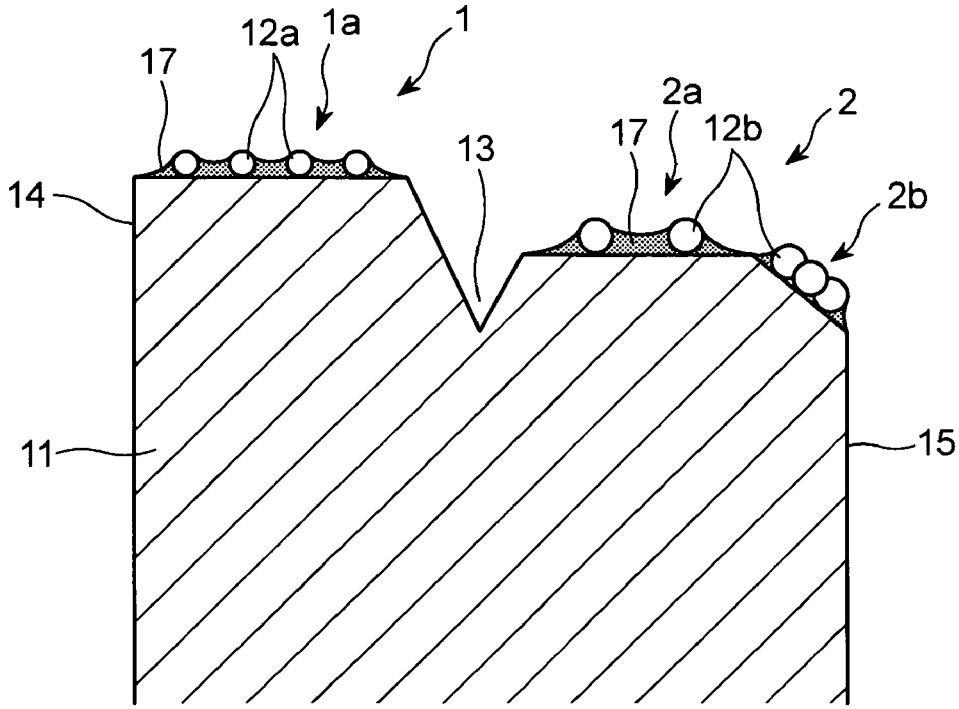
FIG. 2B is a cross-sectional view taken along the line IIB-IIB in FIG. 2A.
Figure 3A:
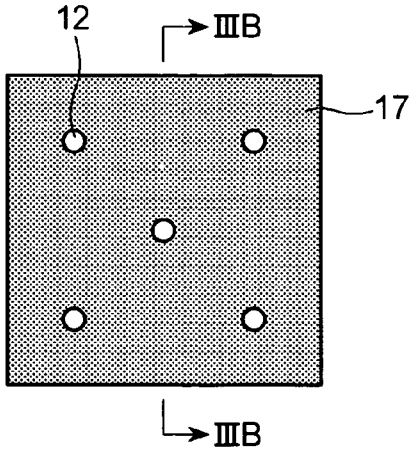
FIG. 3A is a plan view illustrating an abrasive grain singly adhered to a base.
Figure 3B:
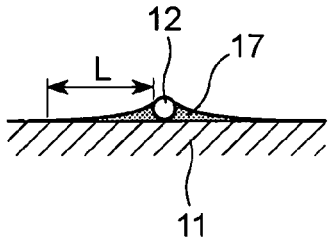
FIG. 3B is a cross-sectional view taken along the line IIIB-IIIB in FIG. 3A.

FIG. 1 is a perspective view of a milling tool in accordance with a first exemplary embodiment of the present invention, FIG. 2A is an enlarged plan view of a portion of the milling tool in accordance with first exemplary embodiment of the present invention, FIG. 2B is a cross-sectional view taken along the line IIB-IIB in FIG. 2A, FIG. 3A is a plan view illustrating an abrasive grain singly adhered to a base, and FIG. 3B is a cross-sectional view taken along the line IIIB-IIIB in FIG. 3A.

As illustrated in FIG. 1, a milling tool 10 in accordance with first exemplary embodiment includes a cylindrical base 11, and a plurality of abrasive grains 12 fixedly brazed onto an end surface 11*b* of the base 11. The abrasive grains 12 are composed of diamond.

The base 11 is composed of steel, and is in the form of a short cylinder. The base 11 includes an end surface 11*b*, an outer peripheral surface 15 extending perpendicularly and outwardly of to the end surface 11*b*, an inner peripheral surface 14 extending perpendicularly and inwardly of to the end surface 11*b*, and an inclined surface 11*e* connecting the end surface 11*b* and the outer peripheral surface 15 to each other.

The base 11 is centrally formed with a through-hole 11*c* along a longitudinal axis thereof, and further with a through-hole 11*a* coaxial with the through-hole 11*c* and having a diameter shorter than a diameter of the through-hole 11*c*. A rotation shaft of a milling machine is inserted into the through-hole 11*c* for rotating the milling tool 10.

The end surface 11*b* extends around the through-hole 11*c*, and hence, is annular in shape.

As illustrated in FIGS. 1, 2A and 2B, the abrasive grains 12 are fixed onto the end surface 11*b* by means of brazing filler material 17.

A circular recess groove 13, which has a V-shaped cross-section, is formed at the end surface 11*b*. The circular recess groove 13 is coaxial with the through-hole 11*c*, and separates the end surface 11*b* into two halves, specifically, a first area 2 closer to the outer peripheral surface 15 and a second area 1 remoter from the outer peripheral surface 15.

Both the first and second areas 2 and 1 are designed planar. The second area 1 has a planar surface la higher than a planar surface 2*a* of the first area 2.

The inclined surface 11*e* is formed at outermost area 2*b* of the first area 2. The inclined surface 11*e* has an angle in the range of 1 to 10 degrees both inclusive relative to the planar surface 2*a* of the first area 2, for instance. The inclination angle of the inclined surface 11*e* is not to be limited to 1 to 10 degrees, but may be set equal to any angle.

In place of designing the surface 11*e* to be an inclined surface, the surface 11*e* may be a rounded surface.

On the end surface 11*b* are fixed the abrasive grains 12 by means of the brazing filler material 17 except an area extending in the vicinity of the inner peripheral surface 14, an area extending in the vicinity of the outer peripheral surface 15, and an area extending in the vicinity of the circular recess groove 13.

The abrasive grains 12 in the first exemplary embodiment are composed of diamond. As an alternative, the abrasive grains 12 may be composed of cBN, for instance.

The abrasive grains 12 are in the form of a polyhedron such as a hexahedron, an octahedron and a dodecahedron. However, the abrasive grains 12 are illustrated as circles in the drawings for simplicity.

A workpiece (not illustrated) is milled by the milling tool 10 as follows.

First, the milling tool 10 is rotated by a milling machine.

Then, the base 11 is inclined so that the inclined surface 11*e* faces downwardly.

Then, the inclined surface 11*e* is compressed onto a surface of the workpiece for roughly milling the workpiece.

Then, the base 11 is returned to an original position, that is, a horizontal position, from an inclined position.

Then, the planar surface 2*a* of the first area 2 is compressed onto a surface of the workpiece, and then, the planar surface 1*a* of the second area 1 is compressed onto a surface of the workpiece. Thus, the workpiece is finished.

As illustrated in FIG. 2A, the abrasive grains 12*a* are disposed one by one with a predetermined space from adjacent ones on the planar surface 1*a* of the second area 1. Since the abrasive grains 12*a* disposed on the planar surface 1*a* of the second area 1 are used for finishing a workpiece, the abrasive grains 12*a* are designed to have a diameter smaller than a diameter of abrasive grains disposed in the first area 2. Specifically, the abrasive grains 12*a* have a diameter selected from diameters in the range of 90 to 500 micrometers both inclusive. In the first exemplary embodiment, the abrasive grains 12*a* have a diameter of 250 micrometers.

As illustrated in FIG. 2A, the abrasive grains 12*b* are disposed one by one with a predetermined space from adjacent ones on the planar surface 2*a* of the first area 2. The abrasive grains 12*b* are designed to have a diameter greater than a diameter of the abrasive grains 12*a* disposed in the second area 1. The abrasive grains 12*b* have a diameter selected from diameters in the range of 350 to 1000 micrometers both inclusive. In the first exemplary embodiment, the abrasive grains 12*b* have a diameter of 500 micrometers.

A plurality of abrasive-grain clusters 16 is disposed on the inclined surface 11*e* in an island-arrangement. That is, the abrasive-grain clusters 16 do not make contact with adjacent ones, in other words, are spaced away from adjacent ones with a constant space therebetween. Each of the abrasive-grain clusters 16 is comprised of the abrasive grains 12*b* disposed on a circumference. That is, the abrasive grains 12*b* are arranged so as to define a circle. The abrasive grains 12*b* are identical with the abrasive grains 12*b* disposed on the planar surface 2*a* of the first area 2.

In the first exemplary embodiment, each of the abrasive-grain clusters 16 is comprised of six abrasive grains 12*b* arranged on a circumference and each disposed to make contact with adjacent ones.

For instance, a user may form the abrasive-grain cluster 16 by visually putting abrasive grains on the inclined surface 11*e* through the use of a pincette the abrasive grains.

Each of the abrasive-grain clusters 16 is spaced away from adjacent ones by a predetermined space. It is preferable that the predetermined space is in the range of 1X to 10X both inclusive wherein X indicates an average diameter of abrasive grains in order to smoothly remove chips and prevent occurrence of chipping.

In the first exemplary embodiment, the abrasive grains 12*a* disposed in the second area 1 have a diameter different from a diameter of the abrasive grains 12*b* disposed in the first area 2. As an alternative, the abrasive grains 12*a* and 12*b* may have a common diameter.

In the first exemplary embodiment, the abrasive grains 12*a* are arranged one by one on the planar surface 1*a* of the second area 1, and the abrasive grains 12*b* are arranged one by one on the planar surface 2*a* of the first area 1. As an alternative, abrasive-grain clusters may be disposed on the planar surface 1*a* of the second area 1 and/or the planar surface 2*a* of the first area 1. The abrasive-grain clusters to be disposed on the planar surface 1*a* of the second area 1 and/or the planar surface 2*a* of the first area 1 are not necessary to be identical with the abrasive-grain clusters 16. They may be designed to have a different arrangement of abrasive grains in comparison with the abrasive-grain clusters 16.

In order to prevent the abrasive grains 12 from falling off the base 1, the abrasive grains 12 are not arranged, but only the brazing filler material 17 is coated in an area situated in the vicinity of the inner peripheral surface 14 and an area situated in the vicinity of the outer peripheral surface 15. If the abrasive grains 12 are arranged in the vicinity of both the inner peripheral surface 14 and the outer peripheral surface 15, the brazing filler material 17 cannot adequately hold the abrasive grains 12, possibly resulting in the abrasive grains 12 falling off the base 1 while a workpiece is being milled. In the milling tool 10 in accordance with the first exemplary embodiment, since the abrasive grains 12 are not only arranged in the vicinity of the recess groove 13, but also in the vicinity of the inner and outer peripheral surfaces 14 and 15, it is possible to prevent the abrasive grains 12 from falling off the base 1 while a workpiece is being milled.

Hereinbelow is explained a holding force with which a single abrasive grain or abrasive grains defining an abrasive-grain cluster is (are) adhered to the base 1 through the brazing filler material 17, with reference to FIGS. 3A to 3F.

Figure 3C:
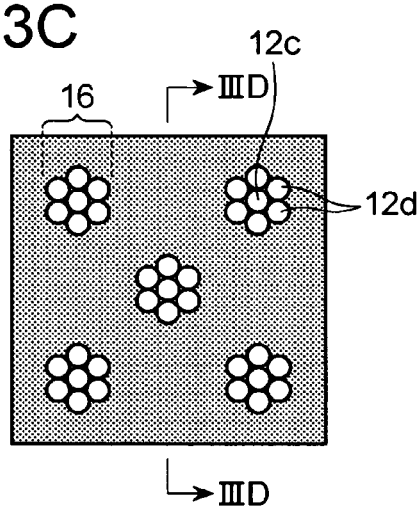
FIG. 3C is a plan view illustrating a conventional abrasive-grain cluster adhered to a base.
Figure 3D:
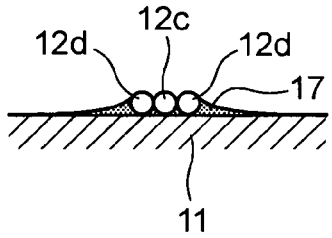
FIG. 3D is a cross-sectional view taken along the line IIID-IIID in FIG. 3C.
Figure 3E:
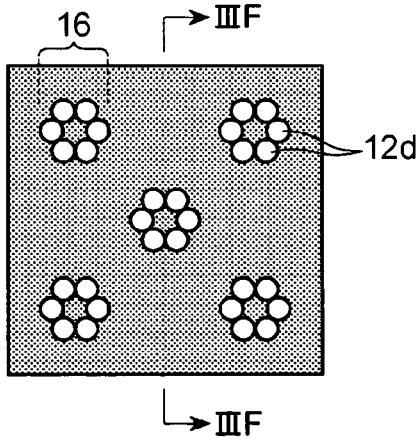
FIG. 3E is a plan view illustrating a abrasive-grain cluster of an exemplary embodiment of the present invention adhered to a base.
Figure 3F:
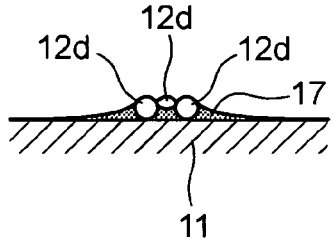
FIG. 3F is a cross-sectional view taken along the line IIIF-IIIF in FIG. 3E.

FIG. 3A is a plan view illustrating an abrasive grain singly adhered to the base 1, FIG. 3B is a cross-sectional view taken along the line IIIB-IIIB in FIG. 3A, FIG. 3C is a plan view illustrating a conventional abrasive-grain cluster adhered to the base 1, FIG. 3D is a cross-sectional view taken along the line IIID-IIID in FIG. 3C, FIG. 3E is a plan view illustrating a abrasive-grain cluster of an exemplary embodiment of the present invention adhered to the base 11, and FIG. 3F is a cross-sectional view taken along the line IIIF-IIIF in FIG. 3E.

If the abrasive grains 12 are disposed one by one, as illustrated in FIG. 3A, the brazing filler material 17 can exist at an adequate volume around all of the abrasive grains 12. Thus, as illustrated in FIG. 3B, the brazing filler material 17 piles up around the abrasive grains 12, and accordingly, the abrasive grains 12 are fixed to the base 11 in such a manner that the abrasive grains 12 are surrounded by the brazing filler material 17. It is preferable that a horizontal length L (see FIG. 3A) of the brazing filler material 17 holding the abrasive grain 12 is equal to or greater than 1X wherein X indicates an average diameter of abrasive grains in order to ensure the abrasive grains 12 to be supported by the brazing filler material 17 with intensive force.

FIGS. 3C and 3D illustrate the conventional abrasive-grain clusters suggested in the above-mentioned Japanese Patent Application Publication No. 2005-279851. Each of the illustrated abrasive-grain clusters 16 is comprised of a central abrasive grain 12*c*, and six abrasive grains 12*d* disposed around the central abrasive grain 12*c*. In general, in an abrasive-grain cluster comprised of a plurality of abrasive grains, a load generated while a workpiece is being milled is separated to the abrasive grains, a force with which the abrasive grains are fixed to the base 11 is often greater than a force with which a single abrasive grain is fixed to the base 11. It is possible to have an advantage of separating a load generated while a workpiece is being milled to a plurality of abrasive grains by designing the abrasive grains to be disposed in the vicinity of one another, whereas a force with which the abrasive grains are fixed to the base 11 through the brazing filler material 17 is smaller than a force with which a single abrasive grain is fixed to the base 11 through the brazing filler material 17, since the brazing filler material 17 is shared by abrasive grains disposed adjacent to each other in an abrasive-grain cluster. In particular, since the central abrasive grain 12*c* shares the brazing filler material 17 with all of the abrasive grains 12*d* disposed therearound, a force with which the central abrasive grain 12*c* is fixed to the base 11 through the brazing filler material 17 is unavoidably smaller than a force with which the abrasive grains 12*d* are fixed to the base 11 through the brazing filler material 17. Accordingly, if an intensive force acts on the abrasive-grain clusters 16 while a workpiece is being milled, the central abrasive grain 12*c* first falls off the base 11. If the central abrasive grain 12*c* fell off the base 11, that is, if the central abrasive grain 12*c* supporting the abrasive grains 12*d* did no longer exist, a force with which the abrasive grains 12*d* are fixed to the base 11 through the brazing filler material 17 is unavoidably reduced, resulting in the possibility of the abrasive grains 12*d* falling off the base 11 is increased.

In contrast, the abrasive-grain cluster 16 illustrated in FIGS. 3E and 3F, which is a part of the milling tool 10 in accordance with the first exemplary embodiment, is comprised of six abrasive grains 12*d* disposed on a circumference and each making contact with adjacent ones. Since a central abrasive grain does not exist within a circumference on which the six abrasive grains 12*d* are arranged, the brazing filler material 17 exists within the circumference. Accordingly, the brazing filler material 17 existing both outside and inside of the circumference ensures the abrasive grains 12*d* to be fixedly adhered to the base 11 therethrough. Furthermore, since all of the abrasive grains 12*d* are uniformly arranged, a load equally acts on each of the abrasive grains 12*d* while a workpiece is being milled, and hence, a particular abrasive grain does not fall off the base 11.

Figure 4A:
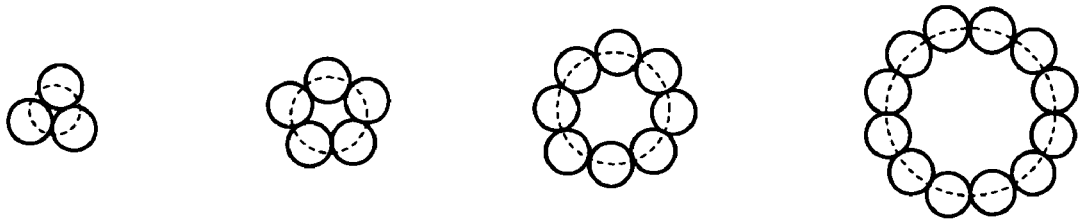
FIG. 4A illustrates examples of arrangement of abrasive grains in an abrasive-grain cluster in the milling tool in accordance with an exemplary embodiment of the present invention.

In the first exemplary embodiment, the six abrasive grains 12*d* are arranged on a certain circumference so as to each make contact with adjacent ones. It should be noted that a number of the abrasive grains 12*d* defining an abrasive-grain cluster is not to be limited to six. For instance, three, five, eight or twelve abrasive grains may be used for defining the abrasive-grain cluster 16, as illustrated in FIG. 4A, if centers of the abrasive grains are disposed on a common circumference.

Figure 4B:
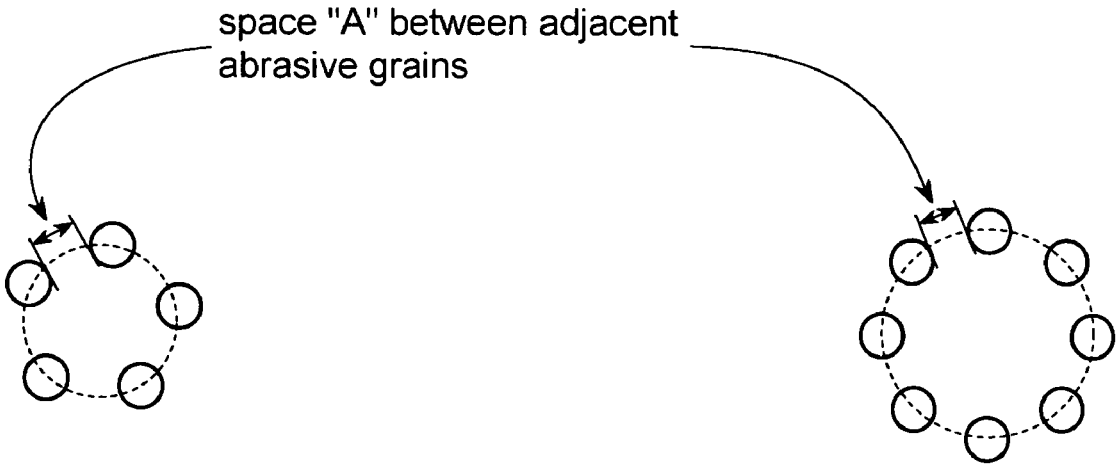
FIG. 4B illustrates examples of arrangement of abrasive grains in an abrasive-grain cluster in the milling tool in accordance with an exemplary embodiment of the present invention.

As an alternative, each of the abrasive grains 12*d* defining the abrasive-grain cluster 16 may be spaced away from adjacent ones, as illustrated in FIG. 4B. In this case, if a space "A" between the adjacent abrasive grains 12*d* is equal to or smaller than 1.2X wherein X indicates a diameter of an abrasive grain, the abrasive grains 12*d* can be firmly fixed to the base 11 by means of the brazing filler material 17 raising up between the adjacent abrasive grains 12*d* due to capillary force.

It is preferable that a number of the abrasive grains 12 arranged on a common circumference for defining the abrasive-grain cluster 16 is in the range of 3 to 8 both inclusive. If the predetermined number were two (2), a load acting on each of the abrasive grains 12 is not adequately reduced, resulting in the abrasive grains 12 likely falling off the base 11. If the predetermined number were eight (8) or more, a circumference on which the abrasive grains 12 are arranged for defining the abrasive-grain cluster 16 would have a longer diameter, and hence, an arc on which the abrasive grains 12 are arranged in succession becomes close to a line, resulting in that generated chips are likely to be caught at the abrasive grains 12, causing that chips are molten there and hence a milling resistance is increased.

It is preferable that, if the abrasive grains are arranged so as to make contact with adjacent ones, a number of the abrasive grains 12 is in the range of 5 to 8 both inclusive. This is because, if the number is three (3) or four (4), the abrasive grains would bite a workpiece too deeply, resulting in the workpiece being flawed.

If a number of the abrasive grains 12 is in the range of 5 to 8 both inclusive, a circumference on which the abrasive grains 12 are arranged would preferably have a diameter in the range of 1.7X to 2.6X both inclusive wherein X indicates an average diameter of the abrasive grains 12. By so designing the diameter, it would be possible to prevent generated chips from being caught at the abrasive-grain clusters to thereby make it possible to smoothly remove chips. If a number of the abrasive grains 12 is greater than eight (8), the effect of reducing the load on each of the abrasive grains by forming the abrasive-grain clusters is no longer improved, and each of the abrasive-grain clusters 16 unavoidably becomes big in size with the result of unpreferable increase in a resistance with which a workpiece is milled.

Hereinbelow are described tested examples.

The milling tool having the structure illustrated in FIGS. 1, 2A and 2B was manufactured, and the milling performance thereof was tested.

The specification of the tested milling tool is as follows. In the tested milling tool, the abrasive grains were arranged one by one on both the planar surface 1*a* of the second area 1 and the planar surface 2*a* of the first area 2, and the abrasive-grain clusters 16 are arranged on the inclined surface 11*e*.

Dimension of the base 11: 125 mm (diameter)×60 mm (height)×18 mm (width)

Width of the second area 1: 20 mm

Width of the first area 2: 13 mm

Width of the inclined surface 11*e*: 7 mm

Material of which the abrasive grains 12 are composed: Diamond

Inner diameter of the abrasive grains 12: 250±25 micrometers

Outer diameter of the abrasive grains 12: 500±50 micrometers

Arrangement of the abrasive grains 12:

(a) Second area 1: 4 rows, Space between adjacent abrasive grains: 0.9 mm (b) First area 2: 2 rows, Space between adjacent abrasive grains: 1.5 mm (c) Inclined surface 11*e*: 1 row (abrasive-grain cluster), Space between adjacent abrasive-grain clusters: 1.5 mm Angle of the inclined surface 11*e*: 3 degrees The conditions under which a workpiece was milled by means of the milling tool were as follows.

Tester: Machining center 5 0.5 kW

R.P.M: 5000

Feeding rate: 1000 mm/min

Milling length: 1.0 mm

Coolant: Water-soluble

Material of which a workpiece is composed: Iron-aluminum complex material (Milling Test 1)

The following abrasive-grain clusters were manufactured.

(a) Example 1: the abrasive-grain cluster 16 comprised of the six abrasive grains arranged on a common circumference and disposed to make contact with adjacent ones (see FIGS. 3E and 3F).

(b) Reference 1: the abrasive grains are arrange one by one on the base 11 (see FIGS. 3A and 3B).

(c) Reference 2: the abrasive-grain cluster 16 comprised of a central abrasive grain and six abrasive grains disposed around the central abrasive grain (see FIGS. 3C and 3D).

The following factors obtained when a workpiece composed of iron-aluminum complex material was milled with Example 1, Reference 1 and Reference 2 were measured.

(a) Surface roughness of an aluminum portion of the workpiece.

(b) Lifespan.

(c) Power consumed for milling one workpiece.

The results of the measurement are shown in Table 1. In Table 1, the lifespan and the consumed power are expressed as an index on the assumption that both the lifespan and the consumed power of Reference 1 are equal to 100. The surface roughness of an aluminum portion of a workpiece was measured by means of a surface roughness tester.

TABLE 1

| | Surface Roughness (μmRZ) | Lifespan (%) | Consumed Power (%) |
|---|---|---|---|
| Example 1 | 3.5 | 160 | 90 |
| Reference 1 | 9.6 | 100 | 100 |
| Reference 2 | 12.3 | 140 | 90 |

It is understood that the surface roughness of an aluminum portion of a workpiece in Example 1 is obviously smaller than the same in References 1 and 2. Furthermore, the lifespan of the milling tool including Example 1 is longer than the same of the milling tool including Reference 1, and the consumed power in Example 1 is less than the same in Reference 1. The reasons are considered as follows. Since a load is separated to the abrasive grains in Example 1 while a workpiece is being milled, each of the abrasive grains bites a workpiece to a smaller degree than Reference 1, and hence, a surface roughness of an aluminum portion of a workpiece of Example 1 is lowered in comparison with that of Reference 1 and further, the abrasive grains of Example 1 are unlikely to be worn out, resulting in an increase in a lifespan of the milling tool. In addition, in the case of Example 1, since there is no generated wasteful load, a resistance with which a workpiece is milled is reduced, and accordingly, power to be consumed for milling a workpiece is reduced.

A lifespan of the milling tool including Reference 2 is longer than a lifespan of the milling tool including Reference 1, and power to be consumed for milling a workpiece in Reference 2 is smaller than the same in Reference 1. However, the surface roughness of the workpiece after milling by the milling tool in Reference 2 is higher than the same in Reference 1. Observing a surface of the milling tool including Reference 2 after a workpiece was milled by means of the milling tool, a lot of the central abrasive grains in the abrasive-grain clusters fell off the base 11. It is considered that the abrasive grains falling off the base 11 act as free abrasive grains, and flaw an aluminum portion of a workpiece, resulting in that the surface roughness of the aluminum portion was increased.

(Milling Test 2)

There were ten manufactured abrasive-gain clusters including a predetermined number of abrasive grains arranged on a common circumference and each making contact with adjacent ones. The ten abrasive-gain clusters included 3, 4, 5, 6, 7, 8, 9, 10, 11 and 12 abrasive grains, respectively.

Figure 5:
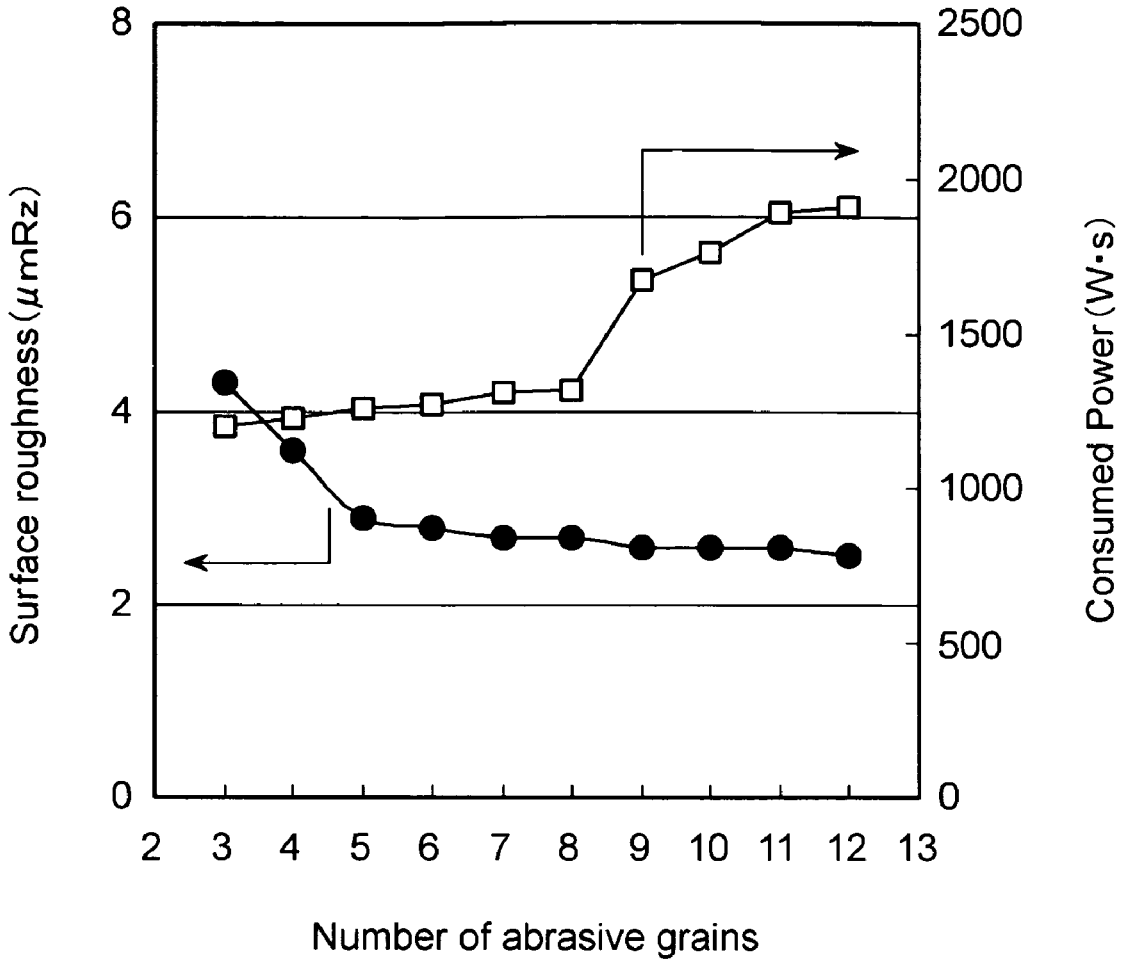
FIG. 5 is a graph showing the results of the milling test having been carried out to the abrasive-grain cluster including three to twelve abrasive grains each arranged to make contact with adjacent ones.

A surface roughness of an aluminum portion of a workpiece, and power to be consumed for milling a workpiece were measured for each of the ten abrasive-gain clusters. The results of the measurement are shown in FIG. 5.

The surface roughness of an aluminum portion of a workpiece reduces as a number of the abrasive grains increases to five (5) from three (3), and keeps almost constant for the abrasive-gain clusters including five or more abrasive grains. This is considered because, though the abrasive-grain cluster including three (3) or four (4) abrasive grains provided an enhanced surface roughness of an aluminum portion of a workpiece relative to Reference 1, a load was not adequately dispersed to each of the abrasive grains while a workpiece was being milled, due to the formation of the abrasive-grain cluster.

The power to be consumed for milling a workpiece gradually increased as a number of the abrasive grains increased to eight (8) from three (3), but remarkably increased when a number of the abrasive grains was over nine (9). Observing a surface of the milling tool after a workpiece was milled by means of the milling tool, a lot of chips molten and adhered around the abrasive grains were found in the abrasive-grain clusters including nine (9) or more abrasive grains. In contrast, almost no such chips were found in the abrasive-grain clusters including three (3) to eight (8) abrasive grains.

(Milling Test 3)

There were four types of manufactured abrasive-gain clusters including a predetermined number of abrasive grains arranged on a common circumference and each being spaced away from adjacent ones with a predetermined space therebetween. The four types of abrasive-gain clusters included 5, 6, 7, and 8 abrasive grains, respectively.

Figure 6:
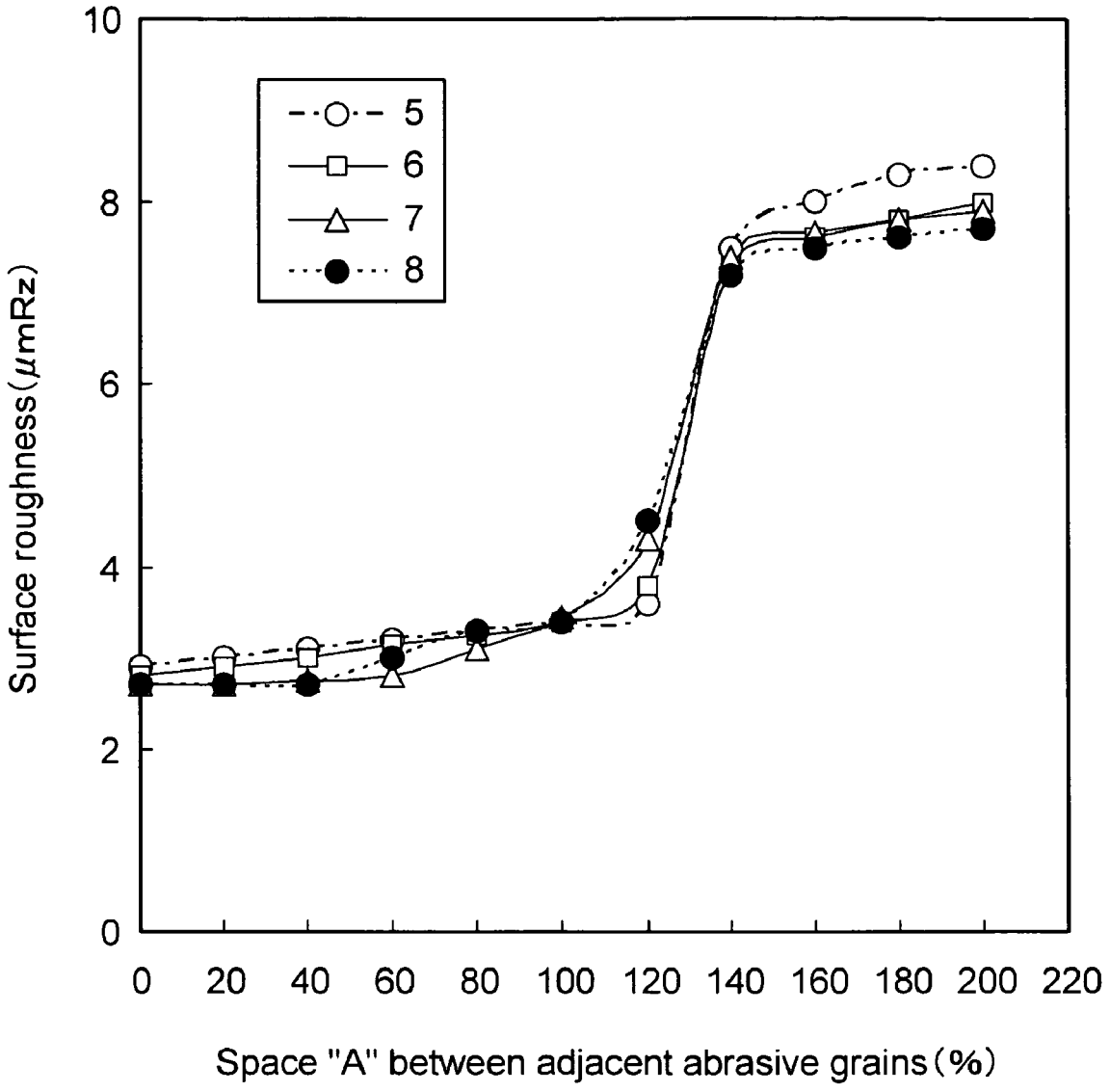
FIG. 6 is a graph showing the results of the milling test having been carried out to the abrasive-grain cluster including five to eight abrasive grains each arranged to be spaced away from adjacent ones.

A surface roughness of an aluminum portion of a workpiece was measured for each of the four types of abrasive-gain clusters. The results of the measurement are shown in FIG. 6. A space "A" between adjacent abrasive grains indicates a space between outer surfaces of the abrasive grains, and is expressed in FIG. 6 as a ratio on the assumption that a diameter of an abrasive grain is equal to 100. Thus, if the space "A" is equal to zero, abrasive grains disposed adjacent to each other make contact with each other.

Observing the abrasive-grain clusters before a workpiece is milled, it was found that the brazing filler material piled up to a top of the abrasive grains in comparison with Reference 1 in the abrasive-grain clusters including five to eight abrasive grains, if the space "A" between adjacent abrasive grains is equal to or smaller than 120%. If the space "A" between adjacent abrasive grains is greater than 120%, the brazing filler material piled up to the same degree as Reference 1.

With respect to the surface roughness of an aluminum portion of a workpiece, the surface roughness kept almost constant in the abrasive-grain clusters including five or six abrasive grains, if the space "A" between adjacent abrasive grains is equal to or smaller than 120%. If the space "A" between adjacent abrasive grains is greater than 120%, the surface roughness of an aluminum portion of a workpiece remarkably increased. The same features as mentioned above were found for the abrasive-grain clusters including seven or eight abrasive grains. However, the surface roughness of an aluminum portion of a workpiece slightly increased even if the space "A" between adjacent abrasive grains is in the range of 100% to 120%, and remarkably increased, if the space "A" between adjacent abrasive grains is greater than 120%. Observing a surface of the milling tool after a workpiece was milled by means of the milling tool, it was found that some abrasive grains fell off the base in the abrasive-grain clusters having a relatively great space "A".

The milling tool in accordance with the present invention is capable of milling, with high accuracy, a workpiece composed of a complex material comprising a harder material and a softer material, such as an iron-aluminum complex material, and can have an enhanced lifespan.

While the present invention has been described in connection with certain exemplary embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A milling tool including a cup-shaped base, and abrasive grains brazed on an end surface of the base, a groove being formed at a boundary between an outer portion comprised of a portion of the end surface of the base closer to an outer edge of the base, and an inner portion comprised of a portion of the end surface of the base closer to an inner edge, the inner portion having a planar surface higher than a planar surface of the outer portion, the outer portion having an outermost edge formed inclined or rounded, characterized in the abrasive-grain clusters are located at the outermost edge with a predetermined space therebetween, each of the abrasive-grain clusters being comprised of 5 to 8 abrasive grains having an almost same diameter, and being positioned substantially on a circumference of a common circle at an almost constant space from adjacent ones, and abrasive grains are not arranged within the common circle defined by abrasive grains of which the abrasive-grain cluster is comprised.

2. The milling tool as set forth in claim 1, wherein said abrasive grains located adjacent to each other in each of the abrasive-grains cluster make contact with each other.

3. The milling tool as set forth in claim 1, wherein said space between said abrasive grains disposed adjacent to each other in each of said abrasive-grain clusters is equal to or smaller than 1.2X wherein X indicates a diameter of said abrasive grains.

4. The milling tool as set forth in claim 1, wherein said predetermined space between said abrasive-grain clusters is in the range of 1X to 10X both inclusive wherein X indicates a diameter of said abrasive grains.

* * * * *